US011867181B2

(12) United States Patent
Leyderman et al.

(10) Patent No.: US 11,867,181 B2
(45) Date of Patent: Jan. 9, 2024

(54) REFRIGERATION SYSTEM HAVING A COMPRESSOR DRIVEN BY A MAGNETIC COUPLING

(71) Applicant: Bascom Hunter Technologies, Inc., Baton Rouge, LA (US)

(72) Inventors: Alexander David Leyderman, Frederick, MD (US); Ralph James Carl, Jr., Clifton Park, NY (US); Graham Walker Lewis, Prairieville, LA (US); Andrew Bascom McCandless, Baton Rouge, LA (US); Jeongkwan Lee, Bellevue, WA (US); Geoffrey Reynolds Harmon, Sammamish, WA (US)

( * ) Notice: Subject to any disclaimer, the term of this patent is extended or adjusted under 35 U.S.C. 154(b) by 269 days.

(21) Appl. No.: 17/084,361

(22) Filed: Oct. 29, 2020

(65) Prior Publication Data

US 2022/0136509 A1 May 5, 2022

(51) Int. Cl.

| | |
|---|---|
| ***F04C 2/00*** | (2006.01) |
| ***F25B 9/08*** | (2006.01) |
| ***F25B 1/08*** | (2006.01) |
| ***F04C 29/00*** | (2006.01) |

(52) U.S. Cl.

CPC ..... *F04C 29/0064* (2013.01); *F25B 1/08* (2013.01); *F25B 9/08* (2013.01)

(58) Field of Classification Search

CPC ..... F25B 1/08; F25B 31/02; F25B 31/006; F25B 9/08; F25B 41/20; F04C 29/0064; F04C 23/008; F04C 29/042; F04C 18/16; F04C 18/0215; F04C 2240/30

See application file for complete search history.

(56) References Cited

U.S. PATENT DOCUMENTS

| | | | | |
|---|---|---|---|---|
| 5,586,876 | A * | 12/1996 | Yasnnascoli | F04C 29/025 418/94 |
| 2001/0026759 | A1* | 10/2001 | Kraner | F04C 19/00 417/68 |
| 2010/0008807 | A1* | 1/2010 | Roof | F04C 23/008 418/55.1 |

FOREIGN PATENT DOCUMENTS

| | | | | |
|---|---|---|---|---|
| EP | 2883996 | A1 * | 6/2015 | D06F 58/08 |
| EP | 3346134 | A1 * | 7/2018 | F04B 39/06 |
| WO | WO 02/057634 | A1 | 7/2002 | |
| WO | WO-2019049226 | A1 * | 3/2019 | F04C 18/356 |

* cited by examiner

*Primary Examiner* — Frantz F Jules
*Assistant Examiner* — Martha Tadesse
(74) *Attorney, Agent, or Firm* — Henry C. Query, Jr.

(57) ABSTRACT

A refrigeration system includes a compressor having a hermetically sealed housing and a compression mechanism which is positioned inside the housing; a condenser which is fluidly connected to the compressor; an evaporator which is fluidly connected between the condenser and the compressor; a magnetic coupling having a drive coupling half positioned outside the housing and a driven coupling half positioned inside the housing and separated from the drive coupling half by a separation wall portion of the housing; and a fluid conduit for communicating a portion of liquid refrigerant from the condenser to an inside surface of the separation wall portion. During operation, the liquid refrigerant from the condenser is evaporated on or adjacent the inside surface of the separation wall portion to thereby dissipate heat generated by magnetically induced eddy currents in the separation wall portion.

20 Claims, 9 Drawing Sheets

REFRIGERATION SYSTEM HAVING A COMPRESSOR DRIVEN BY A MAGNETIC COUPLING

The present invention is directed to a vapor-compression refrigeration system in which the compressor comprises a compression mechanism which is located inside the compressor housing and is driven by a prime mover located outside the compressor housing through a magnetic coupling. More particularly, the present invention is directed to a vapor-compression refrigeration system in which liquid refrigerant from the condenser is used to cool the portion of the compressor housing which is disposed between the magnetic coupling.

BACKGROUND OF THE INVENTION

Prior art vapor-compression refrigeration systems include a number of components connected in a closed refrigeration loop, including a compressor which operates to compress a gaseous refrigerant, a condenser which operates to condense the gaseous refrigerant into liquid form, an expansion valve which operates to lower the pressure of the liquid refrigerant, and an evaporator which operates to evaporate the liquid refrigerant to provide a desired cooling effect.

The compressor includes a compression mechanism which is typically enclosed in a hermetically sealed metal pressure vessel that forms an integral part of the refrigeration loop. The compression mechanism is typically driven by a motor which is also housed in the pressure vessel. As an alternative to driving the compression mechanism with a motor housed in the pressure vessel, certain compressors are designed such that the compression mechanism is driven by a power take-off shaft from a prime mover located outside the pressure vessel. However, this type of compressor usually requires that the power take-off shaft be connected to the compression mechanism through the wall of the pressure vessel.

Magnetic couplings have been used in the prior art to transfer torque across a barrier without breaching the barrier. Magnetic couplings are non-contact, magnet-to-magnet synchronously rotating connections that generate torque between two rotating components without any physical connection between the components. These couplings usually include a drive coupling half which is adapted to be connected to one of the rotating components and a driven coupling half which is adapted to be connected to the other rotating component.

The drive and driven coupling halves of the magnetic coupling each comprise a series of permanent magnets of alternating polarity which, when the magnetic coupling is installed in a particular application, are separated from the permanent magnets of the other coupling half by a fixed gap. The presence of the permanent magnets creates a magnetic field in the gap, and as the magnet poles of the drive and driven coupling halves are displaced from each other in a rotational or azimuthal direction, the magnetic energy contained in the gap changes. This change in magnetic energy with respect to the angular displacement of the magnet poles in turn gives rise to a magnetic torque which is conveyed from the drive coupling half to the driven coupling half. The larger the angular displacement between the magnet poles of the drive and driven coupling halves, the larger the torque obtained, up to a maximum torque angle, which occurs when the magnet poles are displaced relative to each other by half the magnet pole pitch.

Vapor-compression refrigeration systems which employ a magnetic coupling to operatively connect the motor to the compression mechanism are known to exist. For example, International Publication No. WO 02/057634 A1 discloses a vapor-compression refrigeration system in which the compression mechanism is positioned inside a sealed casing 4 and the motor 34 is positioned outside the casing and is coupled to the compression mechanism through a magnetic coupling. As shown in FIG. 5 of this reference, the magnetic coupling includes a drive coupling half 36 which his connected to the motor 34 and a driven coupling half 26 which is connected to the compression mechanism. The drive and driven coupling halves 36, 26 are separated by an end plate 30 of the casing 4. In operation, the torque generated by the motor 34 is magnetically coupled through the end plate 30 by the drive and driven coupling halves 36, 26 to thereby operate the compression mechanism.

In vapor-compression refrigeration systems such as this, where the drive and driven coupling halves are separated by the wall of the pressure vessel, the changing magnetic fields generated by the rotating coupling halves must pass through the wall. If this separation wall is made of an electrically conductive material such as metal, the time varying magnetic fields will produce eddy currents in the wall. These eddy currents will in turn generate Joule losses, which are a significant source of heat, especially for high speed applications. The heat generated by the Joule losses must be dissipated away from the separation wall in order to maintain a reasonable wall temperature.

Maintaining a reasonable wall temperature is important because heat tends to degrade certain lubricants which are used in refrigeration systems. For example, Polyolester oil, a commonly used lubricant in refrigeration systems, starts to decompose at 120° C. Thus, the temperature of the separation wall must be maintained below 120° C. so that the oil does not decompose when it comes in contact with the wall. However, dissipating the heat in the separation wall by convection to the gaseous refrigerant inside the pressure vessel and/or to the outside ambient atmosphere is usually insufficient to maintain a reasonable wall temperature, especially in high speed compressor applications.

Therefore, in vapor-compression refrigeration systems which employ compressors that are driven through a magnetic coupling, a need exists to cool, with a means more effective than convection to surrounding fluids, the metallic wall across which the magnetic coupling transmits torque.

SUMMARY OF THE INVENTION

In accordance with an illustrative embodiment of the present invention, a vapor-compression refrigeration system is disclosed which comprises a compressor which includes a hermetically sealed housing and a compression mechanism which is positioned inside the housing; a condenser which is fluidly connected to the compressor; an evaporator which is fluidly connected between the condenser and the compressor; and a magnetic coupling which includes a drive coupling half positioned outside the housing and a driven coupling half positioned inside the housing and separated from the drive coupling half by a separation wall portion of the housing. The drive coupling half is connectable to a prime mover and the driven coupling half is connected to the compression mechanism to thereby operatively couple the prime mover to the compression mechanism. In operation, the compressor compresses a gaseous refrigerant, the gaseous refrigerant is condensed into a liquid refrigerant in the condenser, and the liquid refrigerant is evaporated in the evaporator. The refrigeration system further comprises a fluid conduit for communicating a portion of the liquid refrigerant from the condenser to an inside surface of the separation wall portion. In this manner, during operation of the refrigeration system, the liquid refrigerant from the condenser is evaporated on or adjacent the inside surface of the separation wall portion to thereby cool the separation wall portion.

In accordance with one embodiment of the invention, the fluid conduit comprises a first end which is in fluid communication with an outlet of the condenser and a second end which is in fluid communication with the inside surface of the separation wall portion. For example, the second end of the fluid conduit may be connected to at least one injection port which extends through the housing to a location adjacent the inside surface of the separation wall portion. The at least one injection port may be configured as a pressure-reducing orifice. Alternatively, the second end of the fluid conduit may be connected to at least one atomizing nozzle which is mounted in the at least one injection port.

In accordance with one embodiment of the invention, the condenser is fluidly connected to the evaporator by a fluid line and the first end of the fluid conduit may be connected to the fluid line.

In accordance with another embodiment of the invention, the refrigeration system may also comprise a metering device for controlling the flow of the liquid refrigerant through the fluid conduit.

In accordance with a further embodiment of the invention, at least one of the driven coupling half and a portion of the housing surrounding the driven coupling half comprises at least one vent duct for communicating the evaporated refrigerant from a side of the driven coupling half facing the separation wall portion to an opposite side of the driven coupling half.

In accordance with yet another embodiment of the invention, at least one of the inside surface of the separation wall portion and an outside surface of the separation wall portion may comprise a number recessed pockets which are separated by a number of radially extending raised webs. For example, the inside surface of the separation wall portion may comprise the recessed pockets, in which event the second end of the fluid conduit may be connected to at least one injection port which extends through the compressor housing to a location adjacent one of the pockets.

In accordance with a further embodiment of the invention, the separation wall portion is comprised of a plurality of stacked, electrically isolated separation plates.

The present invention is also directed to a compressor which comprises a hermetically sealed housing; a compression mechanism which is positioned inside the housing; a magnetic coupling which includes a drive coupling half positioned outside the housing and a driven coupling half positioned inside the housing and separated from the drive coupling half by a separation wall portion of the housing, the drive coupling half being connectable to a prime mover and the driven coupling half being connected the compression mechanism; and at least one injection port which extends through the housing to a location adjacent an inside surface of the separation wall portion. The at least one injection port is connectable to a source of liquid refrigerant such that, in operation of the compressor, liquid refrigerant is communicated through the at least one injection port and evaporated on or adjacent the inside surface of the separation wall portion to thereby cool the separation wall portion.

In accordance with one embodiment of the invention, the at least one injection port may be configured as a pressure-reducing orifice. Alternatively, the liquid refrigerant may be communicated through at least one atomizing nozzle which is mounted in the at least one injection port.

In accordance with another embodiment of the invention, at least one of the driven coupling half and a portion of the compressor housing surrounding the driven coupling half comprises at least one vent duct for communicating the evaporated refrigerant from a side of the driven coupling half facing the separation wall portion to an opposite side of the driven coupling half.

In accordance with a further embodiment of the invention, at least one of the inside surface of the separation wall portion and an outside surface of the separation wall portion may comprise a number recessed pockets which are separated by a number of radially extending raised webs. For example, the inside surface of the separation wall portion may comprise the recessed pockets, in which event the at least one injection port may extend through the housing to a location adjacent one of the pockets.

In accordance with yet another embodiment of the invention, the separation wall portion is comprised of a plurality of stacked, electrically isolated separation plates.

In accordance with still another embodiment of the invention, the refrigeration system may comprise means for controlling the flow of liquid refrigerant through the at least one injection port.

The present invention is further directed to a method for cooling a separation wall portion of a compressor housing, the separation wall portion being positioned between a drive coupling half of a magnetic coupling and a driven coupling half of the magnetic coupling, the drive coupling half being connectable to a prime mover located outside the housing and the driven coupling half being connectable to a compression mechanism located inside the housing. The method comprises communicating a liquid refrigerant to a location adjacent an inside surface of the separation wall portion; and evaporating the liquid refrigerant on or adjacent the inside surface of the separation wall portion to thereby cool the separation wall portion.

Thus, the refrigeration system of the present invention uses the direct injection of liquid refrigerant from the condenser to cool the separation wall where Joule losses generated from eddy currents are created. The liquid refrigerant injected into the lower pressure suction side of the compressor, where the driven coupling half is located, will expand, atomize and partially evaporate. The expansion jet will carry atomized particles of liquid refrigerant towards the source of the generated heat, namely, the separation wall. The mechanism by which the separation wall is cooled is the change of phase from liquid to vapor when the liquid refrigerant vaporizes on the separation wall.

In one embodiment of the invention, the liquid refrigerant is introduced through injection ports in the compressor housing. When the liquid refrigerant impinges upon the separation wall, it changes from the liquid phase to the vapor phase and absorbs heat from the wall. This phase change cooling is orders of magnitude more effective than forced convection cooling.

The invention can be applied to any magnetic coupling known in the art. For example, the drive and driven coupling halves may consist of two discs with axial field profiles or two nested cylinders with radial field profiles. In all cases, the liquid refrigerant may be injected into the gap between the driven coupling half and the separation wall.

Also, the magnetic coupling may be optimized to meet a given torque requirement while minimizing the losses caused by the presence of the separation wall between the drive and driven coupling halves. For an axial flux coupling, some factors that may be optimized can include: the inside diameter of the magnetic pole segments of the drive and driven coupling halves, the outside diameter of the magnetic pole segments, the thickness of the magnetic pole segments, the number of magnetic pole segments, and the size of the gap between the drive and driven coupling halves.

The design of the gap between the drive and driven coupling halves, which may be referred to as the "magnetic gap", depends on a number of factors, including the distance between the driven coupling half and the separation wall. This distance may be optimized so that the liquid refrigerant is properly atomized and distributed over the inside surface of the separation wall. If the distance between the driven coupling half and the separation wall is too small, the atomized refrigerant will not distribute across the surface of the separation wall. If the distance is too large, the magnetic coupling will experience a loss of field strength and torque transfer capability.

In a particular implementation of the invention, the separation wall should be as thin as possible to minimize eddy current generation but sufficiently thick to limit deflection and maintain reasonable stress levels at the highest levels of containment pressure.

In accordance with one embodiment of the invention, vent ducts may be provided in one or both of the driven coupling half or the portion of the housing surrounding the driven coupling half to allow for the vaporized refrigerant to escape from the gap between the separation wall and the driven coupling half and recombine with the main refrigerant flow.

Furthermore, the separation wall need not have a constant or axi-symmetric cross section. In some embodiments, it may be useful for the separation wall to have a webbed structure that reduces the volume of the separation wall. The reduced wall volume results in lower eddy current losses, while maintaining structural integrity. For example, in order to increase structural integrity of the separation wall, the separation wall may be provided with a number of recessed pockets separated by a series of radially extending raised webs. In this embodiment, the injection ports may be arranged in such a way that refrigerant is injected into each of the pockets.

These and other objects and advantages of the present invention will be made apparent from the following detailed description with reference to the accompanying drawings. In the drawings, the same reference numbers are used to denote similar components in the various embodiments.

DETAILED DESCRIPTION OF THE INVENTION

Figure 1:
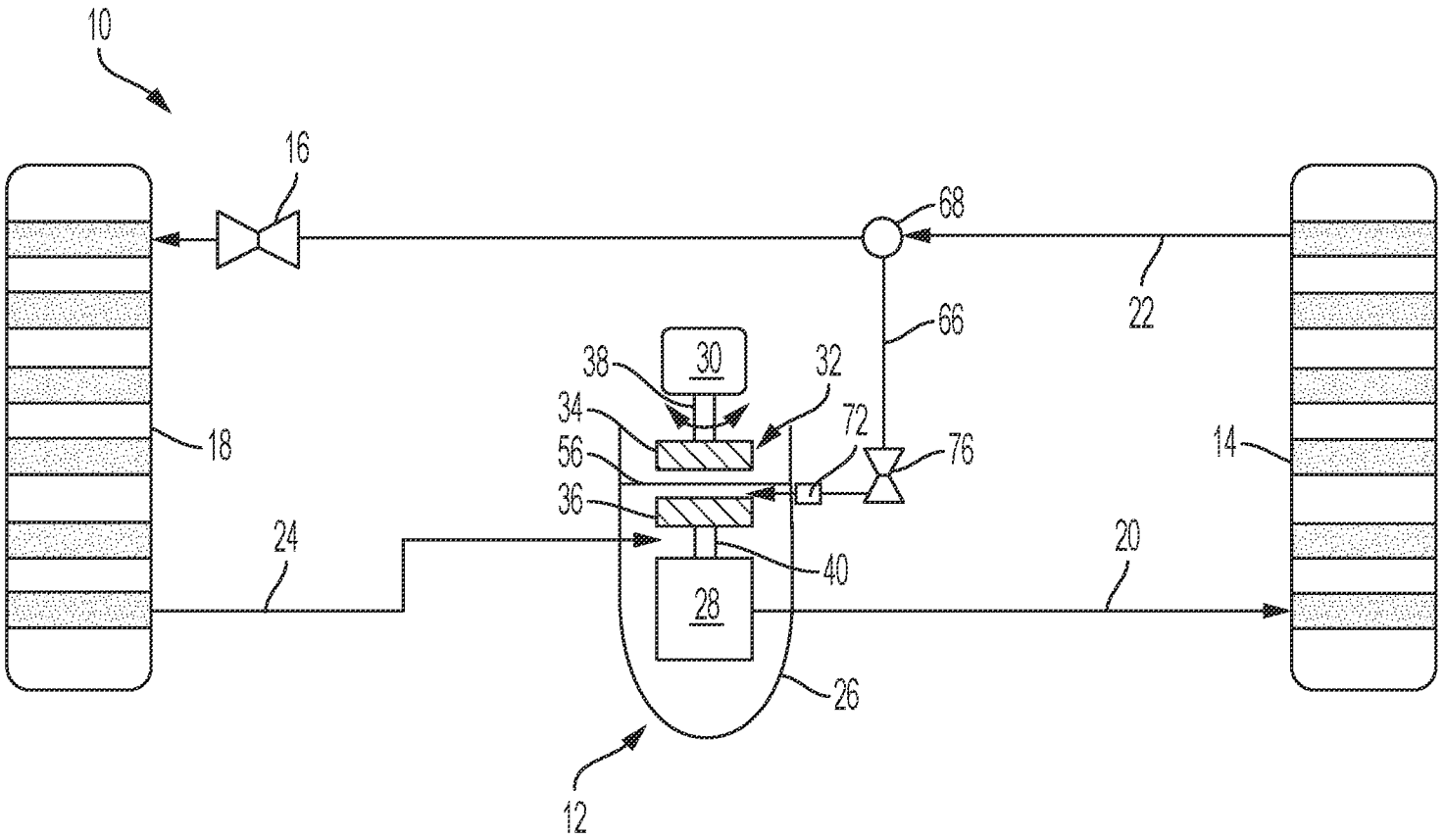
FIG. 1 is a schematic representation of an illustrative embodiment of a refrigeration system of the present invention.

An illustrative embodiment of the refrigeration system of the present invention is shown schematically in FIG. 1. The refrigeration system of this embodiment, generally 10, is a vapor-compression refrigeration system which comprises a number of components connected together in a closed refrigeration loop, including a compressor 12, a condenser 14, an expansion device 16 and an evaporator 18. The outlet of the compressor 12 is connected to the inlet of the condenser 14 by a discharge line 20, the outlet of the condenser 14 is connected to the inlet of the evaporator 18 by a liquid line 22, the outlet of the evaporator 18 is connected to the inlet of the compressor 12 by a suction line 24, and the expansion device 16 is positioned in the liquid line 22 just upstream of the evaporator 18. The vapor-compression refrigeration system 10 is thus similar in most respects to prior art vapor compression refrigeration systems, the specifics of which are known to persons skilled in the art. However, further details of the refrigeration system 10 which are pertinent to the present invention will be described below.

The refrigeration system 10 operates in a manner similar to prior art vapor-compression refrigeration systems. Generally, the compressor 12 receives relatively low pressure gaseous refrigerant from the suction line 24 and compresses it into a relatively high pressure gaseous refrigerant. From the compressor 12, the high pressure gaseous refrigerant is conveyed through the discharge line 20 to the condenser 14, where it condenses into a relatively high pressure liquid. The high pressure liquid refrigerant from the condenser 14 is conveyed through the liquid line 22 to the expansion device 16, where the pressure of the refrigerant is reduced. After passing through the expansion device 16, the relatively low pressure liquid refrigerant flows through the evaporator 18, where it absorbs heat from the ambient environment as it evaporates back into a relatively low pressure gaseous refrigerant. This low pressure gaseous refrigerant is then drawn back into the compressor 12 through the suction line 24. This cycle continues as necessary to achieve a desired cooling effect at the evaporator 18.

The compressor 12 includes a hermetically sealed metal housing 26 and a compression mechanism 28 which is disposed inside the housing 26. The compression mechanism 28 can be any conventional compression device which is normally used to pressurize and circulate a refrigerant through a refrigeration system. Some examples of compression mechanisms 28 which are suitable for use in the refrigeration system 10 of the present invention include a reciprocating compressor, a centrifugal compressor, a scroll compressor and a screw compressor.

The compression mechanism 28 is driven by a prime mover 30 through a magnetic coupling 32. The prime mover 30 can be any device which is capable of driving the compression mechanism 28. Examples of prime movers 30 which are suitable for use in the present invention include, but are not limited to, a power take-off shaft from a turbine, a combustion engine, a hydraulic motor, an air motor and an electric motor.

The magnetic coupling 32 includes a drive coupling half 34 which is positioned outside the housing 26 and a driven coupling half 36 which is positioned inside the housing and is magnetically coupled to the drive coupling half through the wall of the housing. The drive coupling half 34 is connected to a drive shaft 38 which in turn is connected to the prime mover 30, and the driven coupling half 36 is connected to an input shaft 40 of the compression mechanism 28. In the context of the present disclosure, the input shaft 40 may also be referred to as the driven shaft.

In operation of the compressor 12, the prime mover 30 is activated to rotate the drive shaft 38 and, thus, the drive coupling half 34. As will be explained in more detail below, due to the magnetic coupling between the drive coupling half 34 and the driven coupling half 36, rotation of the drive coupling half will cause the driven coupling half to rotate. The driven coupling half 36 will in turn rotate the driven shaft 40 to thereby operate the compression unit 28. In this manner, the magnetic coupling 32 enables the prime mover 30 to drive the compression mechanism 28 without requiring the prime mover to be located within the housing 26 and without the need for a mechanical linkage between the drive and driven shafts 38, 40 that penetrates the wall of the housing. As a result, the size of the housing 26 can be reduced and a potential leak path to the environment can be eliminated. Equally important, the compressor 12 can be powered by any available power take-off shaft from a prime mover that is independent of the compressor.

Figure 2:
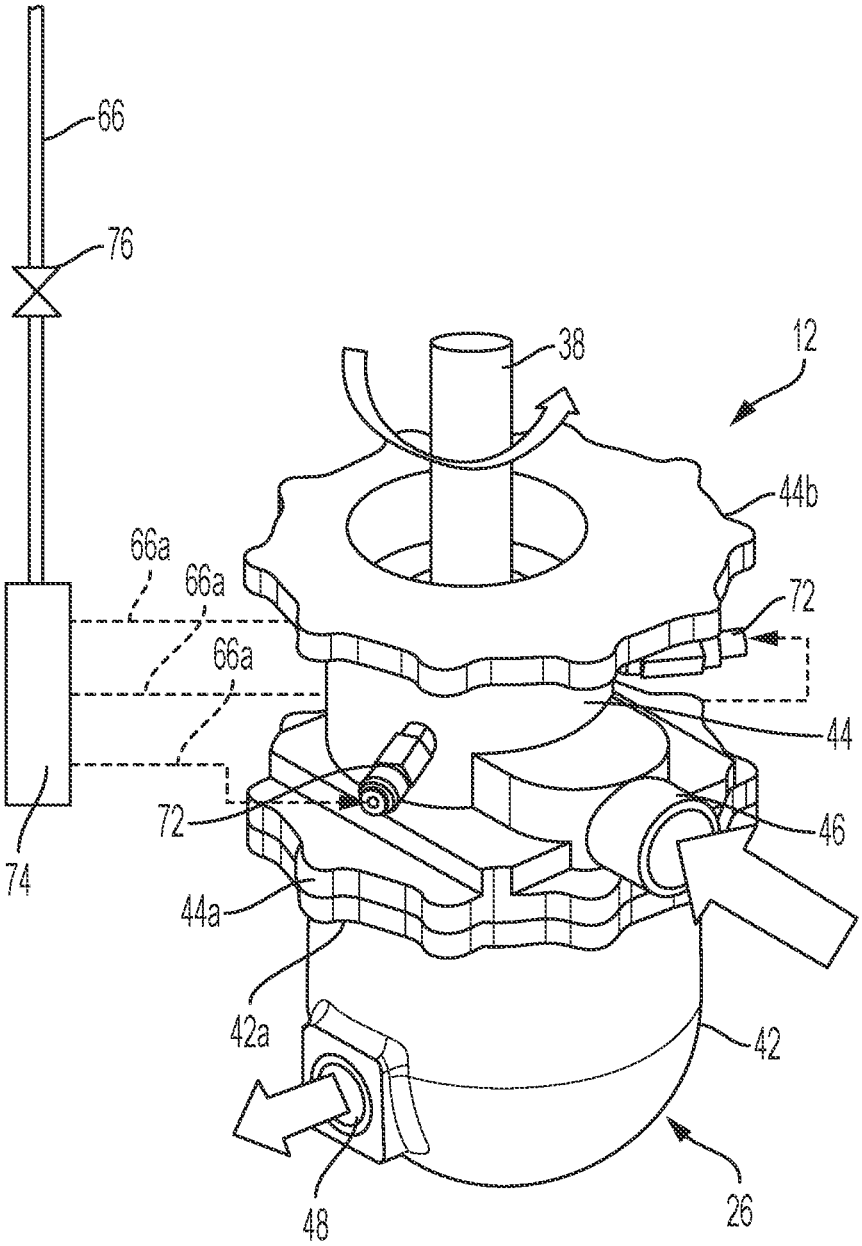
FIG. 2 is a perspective view of an embodiment of a compressor which is suitable for use in the refrigeration system of FIG. 1.
Figure 3:
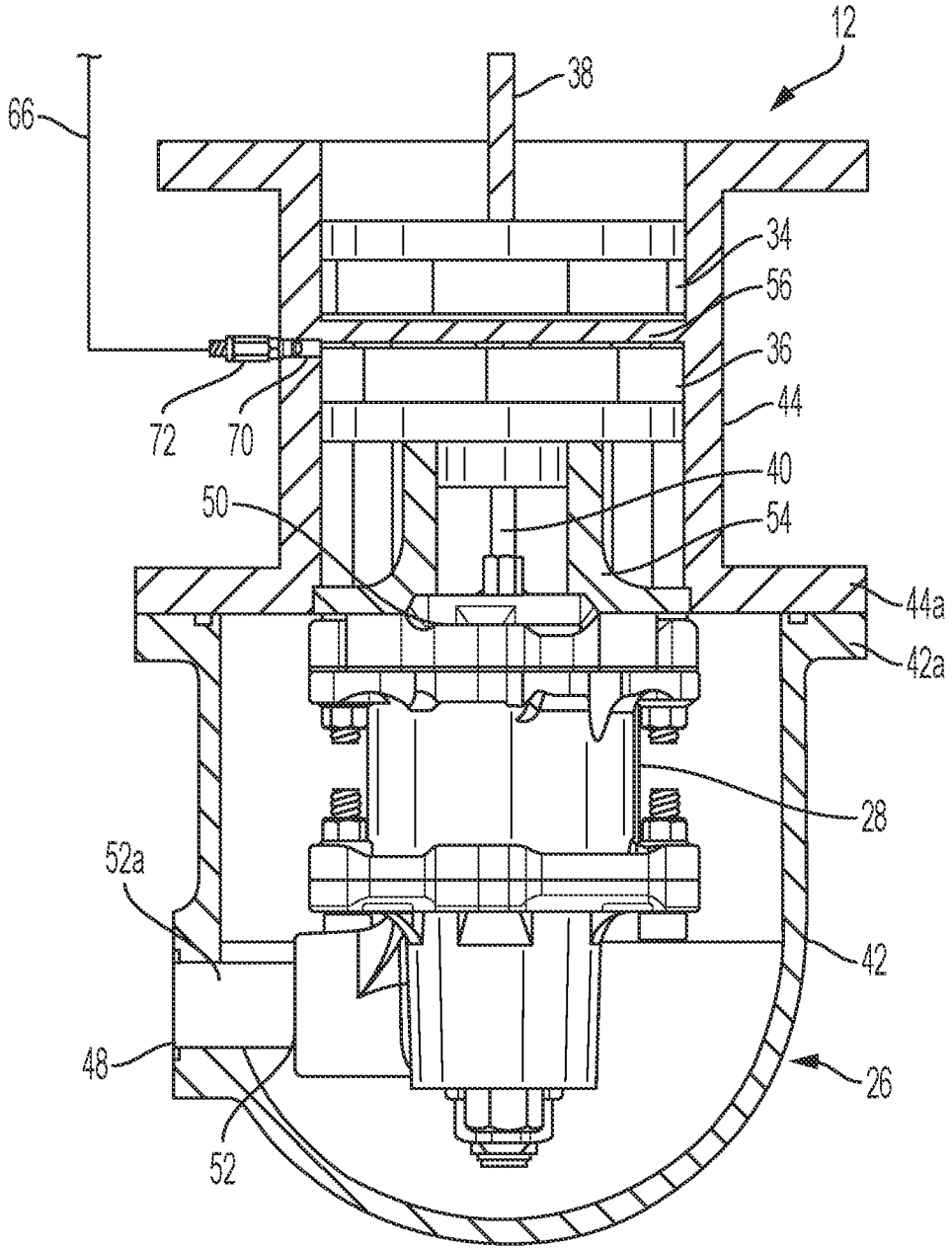
FIG. 3 is a side elevation view of the compressor of FIG. 2 with the outer containment vessel cut away to reveal the components inside.
Figure 4:
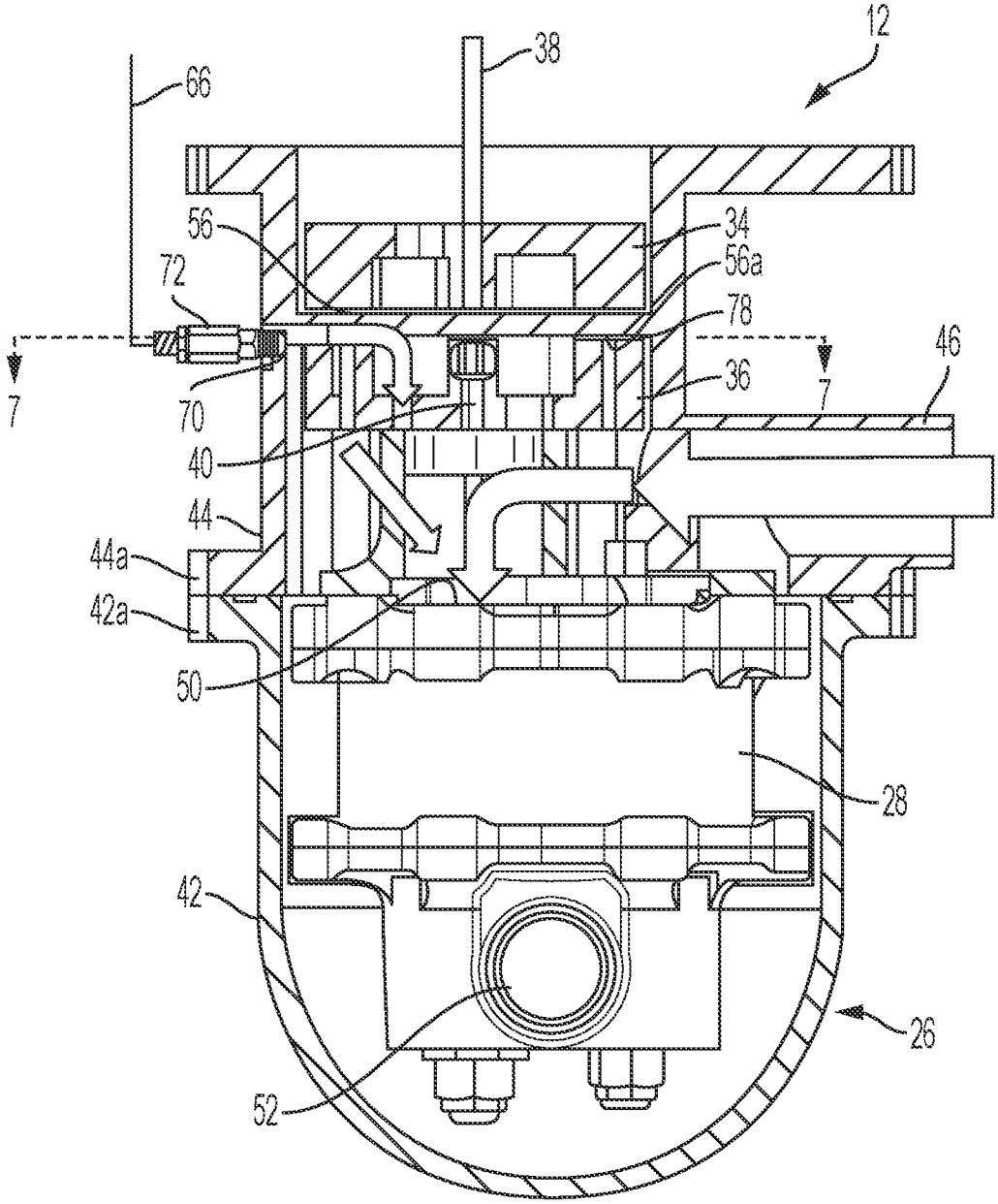
FIG. 4 is a side elevation view of similar to FIG. 3 but with the compressor rotated ninety degrees and the magnetic coupling shown in cross section.

One example of a compressor 12 which is suitable for use in the present invention is shown in FIGS. 2-4. In this embodiment, the compressor housing 26 comprises a first housing part 42 within which the compression mechanism 28 is positioned and a second housing part 44 which is secured and sealed to the first housing part by suitable means to thereby form a hermetically sealed pressure vessel for the compression mechanism. For example, the first and second housing parts 42, 44 may include matching flanges 42*a*, 44*a* which are bolted together and sealed by an appropriate gasket (not shown). In addition, the second housing part 44 may include a mounting flange 44*b* to which the prime mover 30 (not shown) may be mounted.

The housing 26 includes an inlet port 46 which is connected to the suction line 24 and an outlet port 48 which is connected to the discharge line 20. The compression mechanism 28 includes a suction port 50 which is fluidly connected to the inlet port 46 and a discharge port 52 which is fluidly connected via a discharge tube 52*a* to the outlet port 48. In this example, the compression mechanism 28 is supported by a frame member 54 which is connected to the second housing part 44 by suitable means.

As shown in FIGS. 1-3, the drive and driven coupling halves 34, 36 of the magnetic coupling 32 are positioned on opposite sides of a metal wall portion 56 of the compressor housing 26. In this example, the wall portion 56 forms part of the second housing part 44. The wall portion 56, which may be referred to herein as the "separation wall" or the "separation wall portion", is configured to enable the drive and driven coupling halves 34, 36 to be positioned as near as possible to each other while still maintaining the pressure integrity of the housing 26. The wall portion 56 is preferably also configured to accommodate the particular type of magnetic coupling 32 employed in the compressor 12. For example, for the disc-type magnetic coupling 32 shown in the figures, in which the drive and driven coupling halves 34, 36 comprise generally planar opposing faces, the wall portion 56 may be configured as a generally planar member which is oriented generally parallel to the faces. On the other hand, in the case of a coaxial-type magnetic coupling, in which the drive and driven coupling halves take the form of a pair of nested cylinders, the wall portion may be configured as a generally cylindrical member which is positioned between the coupling halves.

Figure 5:
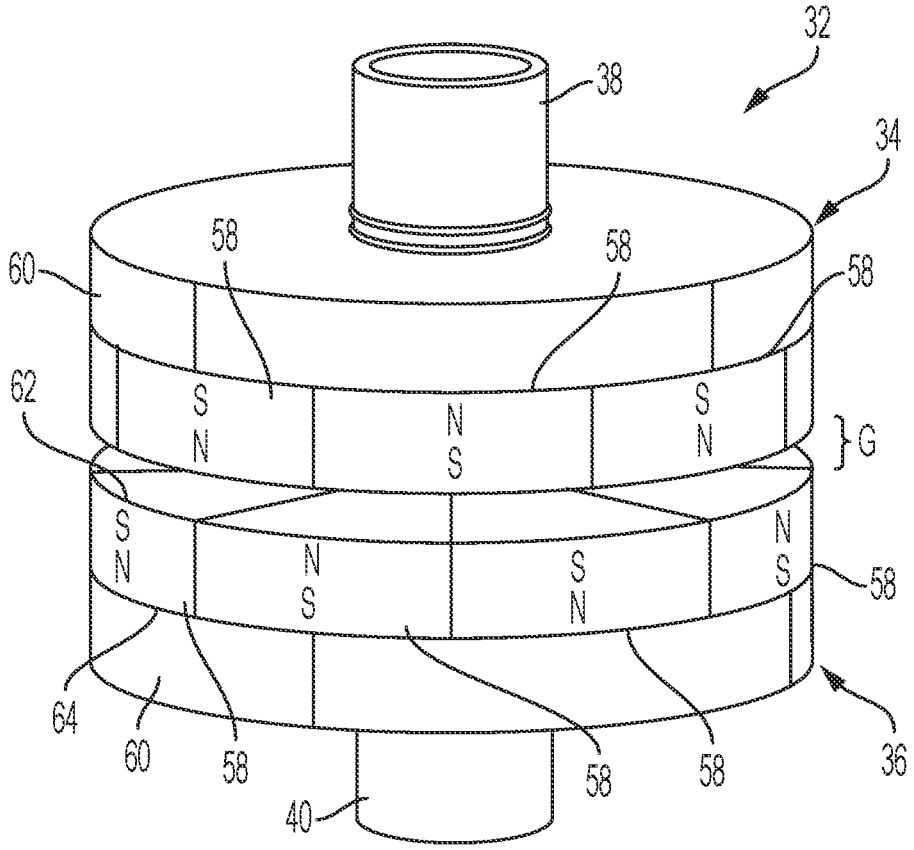
FIG. 5 is an enlarged perspective view of an embodiment of a magnetic coupling which is suitable for use in the compressor of FIG. 2.

The magnetic coupling 32 functions to transmit torque from the drive shaft 38 to the driven shaft 40 across the metal separation wall 56. An enlarged view of the magnetic coupling 32 is shown in FIG. 5. In this example, the drive and driven coupling halves 34, 36 each include a plurality of pie-shaped permanent magnets 58, or "pole arc segments", which are mounted on a disc-shaped magnetic yoke 60 made of a high magnetic permeability material, such as iron or low carbon steel. Each magnetic yoke 60 is connected to a corresponding drive or driven shaft 38, 40, which in turn is supported on suitable bearings (not shown). As shown in FIG. 5, each pole arc segment 58 comprises opposite, generally parallel first and second sides 62, 64 on which the north and south poles are located. The pole arc segments 58 are arranged such that the polarity of each pole arc segment is opposite the polarity of its adjacent pole arc segments. In addition, the coupling halves 34, 36 are oriented such that the pole arc segments 58 face each other across a gap G. In the embodiment shown in FIG. 5, each coupling half 34, 36 comprises eight pole arc segments 58, although the coupling halves could comprise fewer or more pole arc segments.

When the coupling halves 34, 36 are positioned as shown in FIG. 5, a magnetic field is established which extends across the gap G between the pole arc segments 58 of the drive coupling half 34 and the pole arc segments 58 of the driven coupling half 36. When the drive coupling half 34 is rotated, the pole arc segments 58 of the drive coupling half are displaced azimuthally with respect to the pole arc segments 58 of the driven coupling half 36. The relative angular displacement between the magnet pole arc segments of the drive and driven coupling halves 34, 36 induces a torque on the driven coupling half 34. In this manner, the torque from the drive coupling half 34 is transferred to the driven coupling half 36 without the need for a physical connection between the coupling halves.

The magnetic coupling 32 provides an effective means for transferring torque from the drive shaft 38 to the driven shaft 40 without breaching the metal separation wall 56. However, the time-varying magnetic field penetrating the separation wall 56 between the drive and driven coupling halves 34,36 induces eddy currents in the separation wall which generate Joule losses. These Joule losses are a significant source of heat, especially in high speed compressor applications (e.g., those operating on the order of 10,000 rpm), and this heat has the potential to significantly raise the temperature of the separation wall 56 unless it is removed.

In accordance with the present invention, the refrigeration system 10 is provided with means for dissipating the heat generated by Joule losses in the metal separation wall 56 during operation of the compressor 12. In general, the invention involves directing a portion of liquid refrigerant onto or adjacent the inside surface of the separation wall 56. As the liquid refrigerant impinges on the metal separation wall 56, it evaporates and thereby removes a significant portion of the heat generated by the Joule losses.

In one embodiment of the invention, the liquid refrigerant is introduced into the volume adjacent the inside surface of the separation wall 56 through one or more injection ports. The injection ports may be configured such that, when the refrigerant passes through the injection ports, the decrease in pressure creates an atomized stream of refrigerant which impinges on the separation wall 56. As this atomized stream impinges on the separation wall 56, the refrigerant evaporates from the liquid state to the gaseous state, absorbing heat from the separation wall in the process. This gaseous refrigerant is then drawn into the suction port 50 of the compression mechanism 28 and compressed along with the gaseous refrigerant from the evaporator 18.

The liquid refrigerant used to cool the separation wall 56 may be obtained, for example, from the condenser 14. In this example, the refrigeration system may include a fluid conduit for communicating a portion of the liquid refrigerant from the condenser 14 to the inside surface of the separation wall 56.

Referring again to FIGS. 1-4, for example, the refrigeration system 10 may comprise a fluid conduit 66 having a first end which is connected to the liquid line 22 and a second end which is in fluid communication with the inside surface of the separation wall 56. The first end of the fluid conduit 66 may be connected to a suitable fitting or tap 68 in the liquid line 22 and, as shown in FIG. 3, the second end of the fluid conduit may be connected to an injection port 70 which is formed in the housing 26 axially adjacent the separation wall 56. In order to ensure that the liquid refrigerant is atomized prior to impinging on the inside surface of the separation wall 56, the injection port 70 may be configured as a pressure-reducing orifice. Alternatively, the second end of the fluid conduit 66 may be connected to an atomizing nozzle 72 which is mounted in the injection port 70.

In the particular embodiment of the invention shown in the drawings, the refrigeration system 10 comprises three nozzles 72, each of which is mounted in a corresponding injection port 70 located axially adjacent the separation wall 56. In this embodiment, the second end of the fluid conduit 66 may be connected to a manifold or similar flow splitting device 74 which in turn is connected to the nozzles 72 through respective branch conduits 66*a* (see FIG. 2). Of course, it should be understood that the refrigeration system 72 could have more or fewer than three injection ports 70 and/or nozzles 72, depending on the particular cooling requirements of the separation wall 56. The refrigeration system 10 may also include a metering valve 76 to control the mass flow rate of the liquid refrigerant injected onto the separation wall 56. The metering valve 76 acts to regulate the flow of liquid refrigerant to the separation wall 56 so that the separation wall is maintained at a reasonable temperature. The metering valve 76 is controlled based on input from a suitable temperature sensor that measures the temperature of the separation wall 56 using techniques known to the art for controlling temperature based on the mass flow of a coolant.

Figure 6:
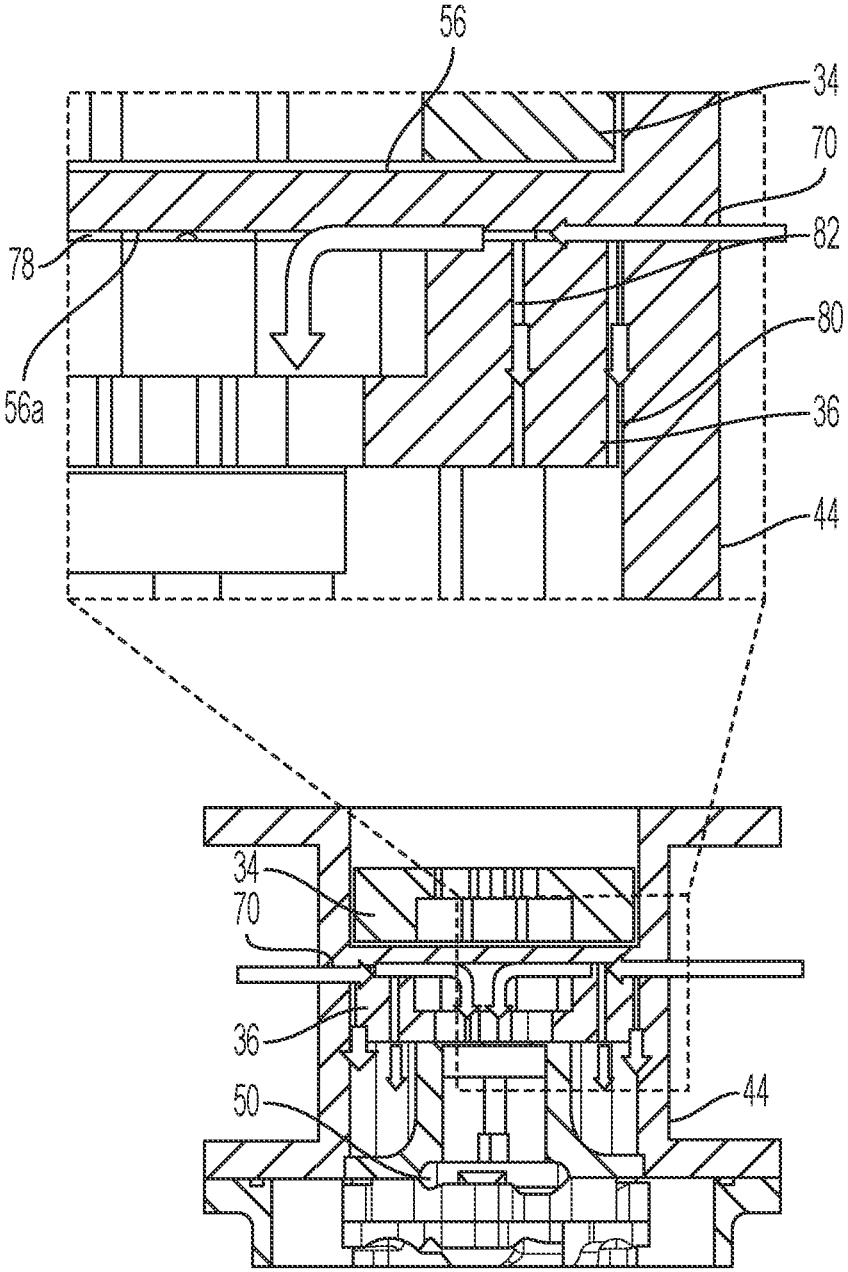
FIG. 6 is a partial cross sectional view of a portion of the compressor of FIG. 2, together with an enlargement of the outlined section.
Figure 7:
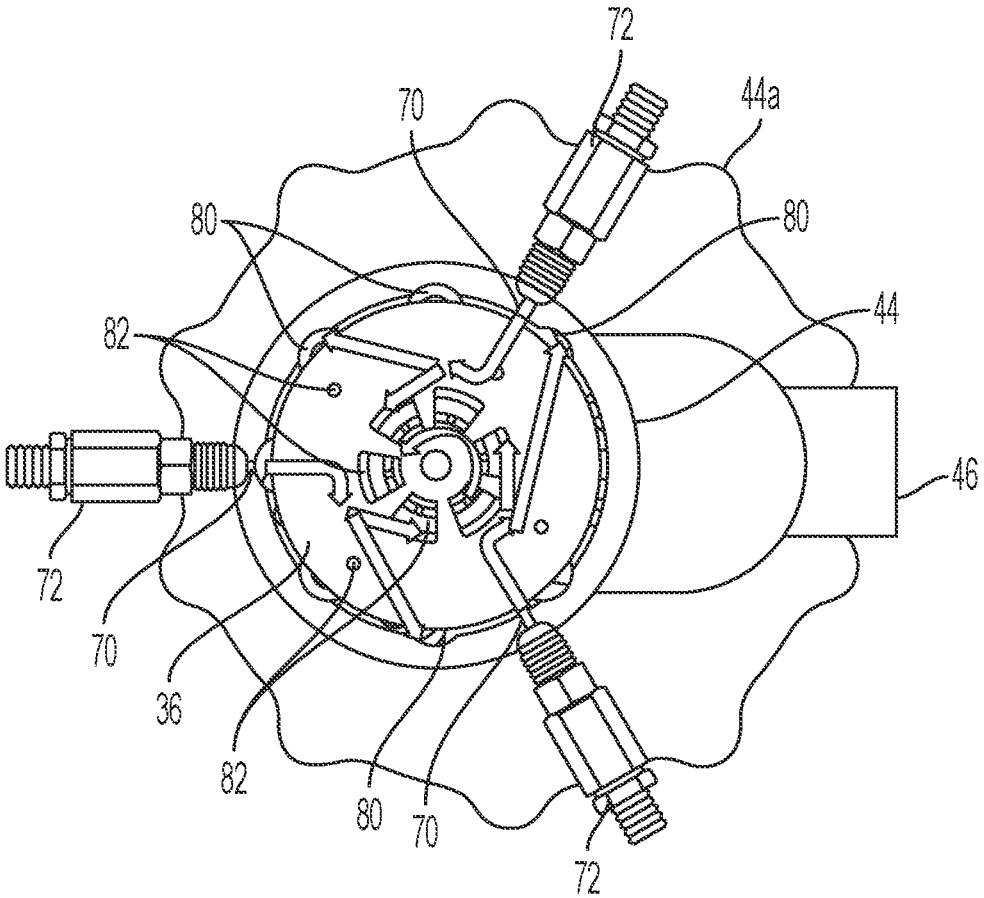
FIG. 7 is a cross sectional view of the compressor of FIG. 2 taken along line 7-7 of FIG. 4.

As mentioned above, the liquid refrigerant which is redirected from the condenser 14 is communicated into the area adjacent the inside surface of the separation wall 56. As depicted by the arrows in FIG. 4, the liquid refrigerant may be communicated into a gap 78 located between the driven coupling half 36 and the inside surface 56*a* of the separation wall 56. Referring also to FIGS. 6 and 7, the refrigerant (represented by the arrows) exits the injection ports 70 and proceeds generally radially into the gap 78. As the liquid refrigerant exits the injection ports, it experiences a drop in pressure which causes it to atomize. This atomized refrigerant then impinges on the inner surface 56*a* of the separation wall 56 and evaporates, absorbing heat from the separation wall in the process. As shown in FIG. 4, the resulting gaseous refrigerant then combines with the gaseous refrigerant from the evaporator 18 and enters the suction port 50 of the compression mechanism 28.

In order to facilitate the flow of the gaseous refrigerant back into the suction port 50 of the compression mechanism 28, the housing 26 or the driven coupling half 36, or both, may be provided with a number of vent ducts which extend from the gap 78 to the area below the driven coupling half 36. As shown in FIGS. 6 and 7, for instance, the portion of the housing 26 (or the second housing part 44) which surrounds the driven coupling half 36 may comprise a number of recesses 80 which extend axially from the gap 78 to the area below the driven coupling half. Alternatively, or in addition, the driven coupling half 36 may comprise a number of passages 82 which extend axially completely through the driven coupling half. These vent ducts 80, 82 enable the vaporized refrigerant to escape from the gap 78 between the separation wall 56 and the driven coupling half 36 and enter the suction port 50 of the compression mechanism 28.

Figure 8:
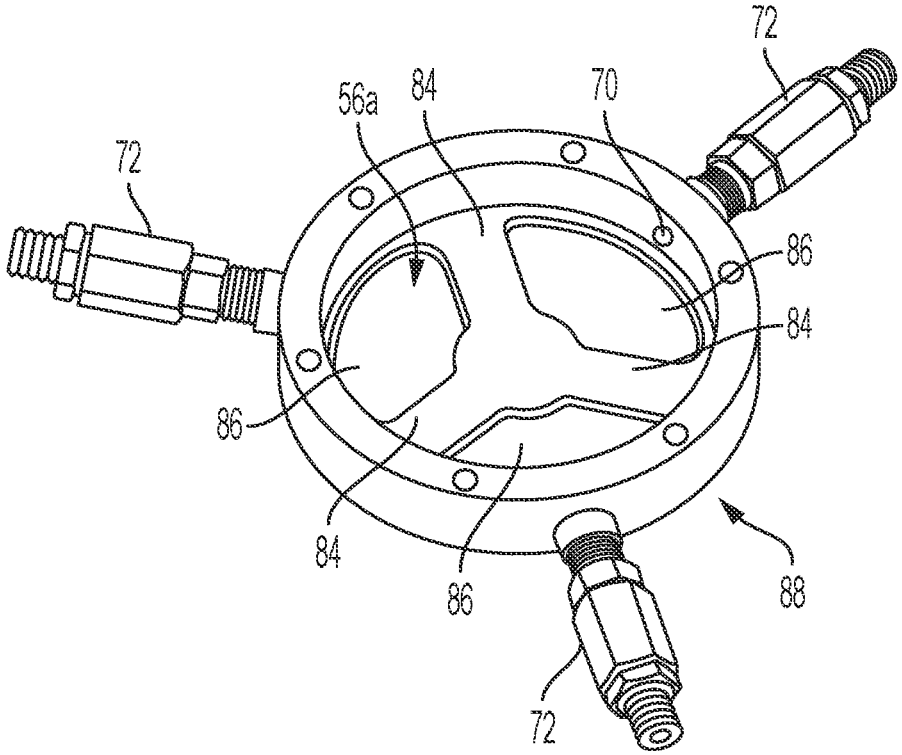
FIG. 8 is a perspective view of a removable end cap-type separation wall for a compressor housing which is suitable for use with the refrigeration system of the present invention.

Referring now to FIG. 8, in one embodiment of the invention the inside surface 56*a* of the separation wall 56 may be formed with a number of radially extending raised webs 84 and a number of recessed pockets 86. In this context, the terms "raised" and "recessed" should be interpreted as relative to each other. Thus, the webs 84 are raised relative to the pockets 86, and the pockets 86 are recessed relative to the webs 84. In the embodiment shown in FIG. 8, the inside surface 56*a* of the separation wall portion 56 comprises three pockets 86 which are separated by an equal number of webs 84. This webbed structure maintains much of the structural integrity of a solid flat plate but experiences less eddy current losses due to the reduced volume of electrically conductive material between the drive and driven coupling halves. The number of webs 84 may be odd and is preferably less than the number of magnetic pole segments 58 of the drive and driven coupling halves. Also, the injection ports 70 may be arranged such that the liquid refrigerant is injected into the pockets 86 in order to enhance the contact of the atomized refrigerant with the inside surface 56*a* of the separation wall 56. In this embodiment, the separation wall 56 forms part of a removable flanged end cap 88 which can be bolted or otherwise connected to the first housing part 42 to form a hermetically sealed housing for the compression mechanism 28.

Figure 9:
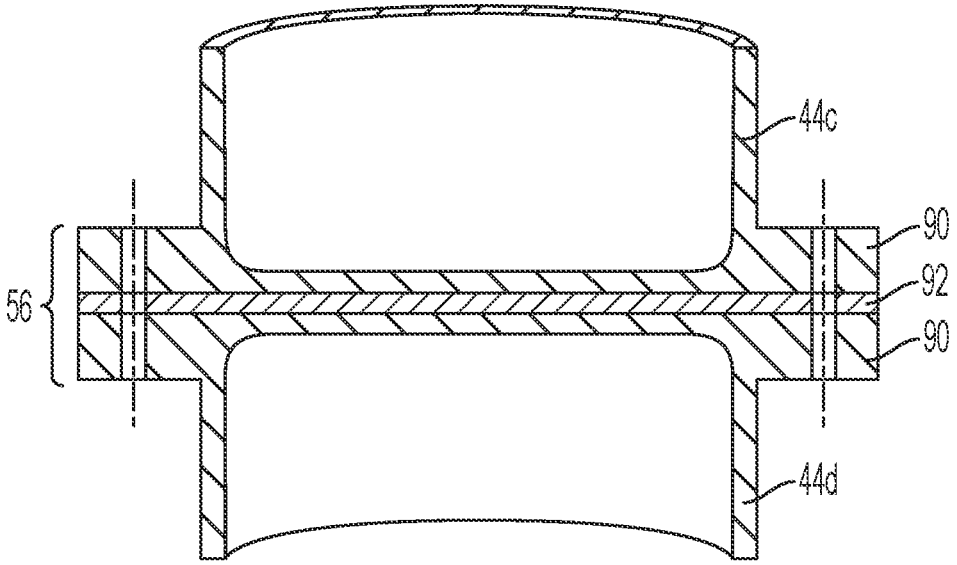
FIG. 9 is a cross sectional representation of an embodiment of the separation wall of a compressor housing which is suitable for use in the refrigeration system of the present invention.

FIG. 9 depicts an embodiment of the invention in which the separation wall 56 is comprised of a plurality of individual stacked separation plates. In this example, the separation wall 56 comprises two separation plates in the form of blind flanges 90. The blind flanges 90 are connected to or formed integrally with respective housing parts 44*c*, 44*d* and secured together by bolts or other suitable means (not shown) to form the second housing section 44. If desired or required by a particular application, one or more additional separation plates 92 may be positioned between the blind flanges 90.

The separation plates 90, 92 are electrically isolated from each other by, e.g., coating their adjacent surfaces with an oxide film. In this embodiment, the eddy currents generated in the separation wall 56 in response to the time-varying magnetic field generated between the drive and driven coupling halves 34, 36 are reduced compared to those generated in the one-piece separation wall of the previous embodiments. Thus, for a given diameter and thickness of the separation wall 56, the use of a plurality of electrically isolated separation plates 90, 92 instead of a solid separation wall will result in less Joule losses, which in turn will require that less heat be removed from the separation wall.

It should be recognized that, while the present invention has been described in relation to the preferred embodiments thereof, those skilled in the art may develop a wide variation of structural and operational details without departing from the principles of the invention. For example, various features of the different embodiments may be combined in a manner not described herein. Therefore, the appended claims should be construed to cover all equivalents falling within the true scope and spirit of the invention.

What is claimed is:

1. A refrigeration system comprising:

a compressor which includes a hermetically sealed housing and a compression mechanism positioned inside the housing;

a condenser which is fluidly connected to the compressor;

an evaporator which is fluidly connected between the condenser and the compressor; and a magnetic coupling which includes a drive coupling half positioned outside the housing and a driven coupling half positioned inside the housing and separated from the drive coupling half by a separation wall portion of the housing, the drive coupling half being connectable to a prime mover and the driven coupling half being connected to the compression mechanism;

wherein in operation of the refrigeration system, the compressor compresses a gaseous refrigerant, the gaseous refrigerant is condensed into a liquid refrigerant in the condenser, and the liquid refrigerant is evaporated in the evaporator; and wherein the refrigeration system further comprises a fluid conduit for communicating a portion of the liquid refrigerant from the condenser to an inside surface of the separation wall portion;

whereby during operation of the refrigeration system, the liquid refrigerant from the condenser is evaporated on or adjacent the inside surface of the separation wall portion to thereby cool the separation wall portion.

2. The refrigeration system of claim 1, wherein the fluid conduit comprises a first end which is in fluid communication with an outlet of the condenser and a second end which is in fluid communication with the inside surface of the separation wall portion.

3. The refrigeration system of claim 2, wherein the second end of the fluid conduit is connected to at least one injection port which extends through the housing to a location adjacent the inside surface of the separation wall portion.

4. The refrigeration system of claim 3, wherein the at least one injection port is configured as a pressure-reducing orifice.

5. The refrigeration system of claim 3, wherein the second end of the fluid conduit is connected to at least one atomizing nozzle which is mounted in the at least one injection port.

6. The refrigeration system of claim 2, wherein the condenser is fluidly connected to the evaporator by a fluid line and the first end of the fluid conduit is connected to the fluid line.

7. The refrigeration system of claim 2, further comprising a metering device for controlling the flow of the liquid refrigerant through the fluid conduit.

8. The refrigeration system of claim 2, wherein at least one of the driven coupling half and a portion of the housing surrounding the driven coupling half comprises at least one vent duct for communicating the evaporated refrigerant from a side of the driven coupling half facing the separation wall portion to an opposite side of the driven coupling half.

9. The refrigeration system of claim 2, wherein at least one of the inside surface of the separation wall portion and an outside surface of the separation wall portion comprises a number recessed pockets which are separated by a number of radially extending raised webs.

10. The refrigeration system of claim 9, wherein the inside surface of the separation wall portion comprises the recessed pockets and the second end of the fluid conduit is connected to at least one injection port which extends through the compressor housing to a location adjacent one of the pockets.

11. The refrigeration system of claim 2, wherein the separation wall portion is comprised of a plurality of stacked, electrically isolated separation plates.

12. A compressor comprising:

a hermetically sealed housing;

a compression mechanism which is positioned inside the housing;

a magnetic coupling which includes a drive coupling half positioned outside the housing and a driven coupling half positioned inside the housing and separated from the drive coupling half by a separation wall portion of the housing, the drive coupling half being connectable to a prime mover and the driven coupling half being connected the compression mechanism; and at least one injection port which extends through the housing to a location adjacent an inside surface of the separation wall portion, the at least one injection port being connectable to a source of liquid refrigerant;

wherein during operation of the compressor, liquid refrigerant is communicated through the at least one injection port and evaporated on or adjacent the inside surface of the separation wall portion to thereby cool the separation wall portion.

13. The compressor of claim 12, wherein the at least one injection port is configured as a pressure-reducing orifice.

14. The compressor of claim 12, wherein the liquid refrigerant is communicated through at least one atomizing nozzle which is mounted in the at least one injection port.

15. The compressor of claim 12, wherein at least one of the driven coupling half and a portion of the compressor housing surrounding the driven coupling half comprises at least one vent duct for communicating the evaporated refrigerant from a side of the driven coupling half facing the separation wall portion to an opposite side of the driven coupling half.

16. The compressor of claim 12, wherein at least one of the inside surface of the separation wall portion and an outside surface of the separation wall portion comprises a number recessed pockets which are separated by a number of radially extending raised webs.

17. The compressor of claim 16, wherein the inside surface of the separation wall portion comprises the recessed pockets and the at least one injection port extends through the housing to a location adjacent one of the pockets.

18. The compressor of claim 12, wherein the separation wall portion is comprised of a plurality of stacked, electrically isolated separation plates.

19. The compressor of claim 12, further comprising means for controlling the flow of liquid refrigerant through the at least one injection port.

20. A method for cooling a separation wall portion of a compressor housing, the separation wall portion being positioned between a drive coupling half of a magnetic coupling and a driven coupling half of the magnetic coupling, the drive coupling half being connectable to a prime mover located outside the housing and the driven coupling half being connectable to a compression mechanism located inside the housing, the method comprising:

communicating a liquid refrigerant to a location adjacent an inside surface of the separation wall portion; and evaporating the liquid refrigerant on or adjacent the inside surface of the separation wall portion to thereby cool the separation wall portion.

* * * * *